United States Patent [19]

Ruhle

[11] Patent Number: 4,661,052

[45] Date of Patent: Apr. 28, 1987

[54] RECIPROCATING DOWN-HOLE SAND PUMP

[76] Inventor: James L. Ruhle, 2535 E. Balfour Ave., Fullerton, Calif. 92631

[21] Appl. No.: 673,124

[22] Filed: Nov. 19, 1984

[51] Int. Cl.[4] ..... F04B 21/04; F04B 39/10; E21B 43/00

[52] U.S. Cl. ..... 417/552; 166/105; 166/105.1

[58] Field of Search ..... 166/105, 105.1, 107; 417/552 G, 554

[56] References Cited

U.S. PATENT DOCUMENTS

| | | | |
|---|---|---|---|
| 278,575 | 3/1857 | Reynolds | 166/107 |
| 2,039,621 | 5/1936 | Behnke | 166/105 |
| 2,325,503 | 7/1943 | Goble | 166/107 |
| 2,646,128 | 7/1953 | Reynolds | 166/107 |
| 3,138,215 | 6/1964 | Cook | 166/107 |
| 3,592,567 | 7/1971 | Tolbert | 417/554 |
| 4,190,113 | 7/1978 | Harrison | 166/107 |
| 4,421,182 | 12/1983 | Moody | 166/105.1 |
| 4,478,285 | 10/1984 | Caldwell | 166/105.1 |

*Primary Examiner*—William L. Freeh

[57] ABSTRACT

A positive-displacement single-acting down-hole reciprocating pump for excavating and conveying to the surface accumulations of sand and other detritus that collects at the bottom of producing oil, gas, geothermal, and water-supply wells. The down-hole sand pump is activated by the axial oscillation of a steel cylindrical weighted momentum unit, which, in turn, is axially oscillated by a string of light-weight composite pipe, which in turn is axially oscillated at the surface. The sand and other detritus, along with the circulation fluid, is drawn into suction ports in the down-hole sand pump, and is conveyed upward through the pump, through the weighted momentum unit, and through the light-weight string of composite pipe to the surface. The down-hole sand pump is equipped with an extrusion-resistant self-lubricating pressure-activated spring-loaded self-activated and self-adjusting seal and wiper system that is pressure-activated on the compression strokes, and self-actuates during suction strokes, while it automatically self-adjusts to compensate for wear at the V-ring lips, and is designed in such a manner that prevents extrusion of the V-rings in high temperature and high-pressure applications.

1 Claim, 1 Drawing Figure

RECIPROCATING DOWN-HOLE SAND PUMP

BACKGROUND

Figure 1:
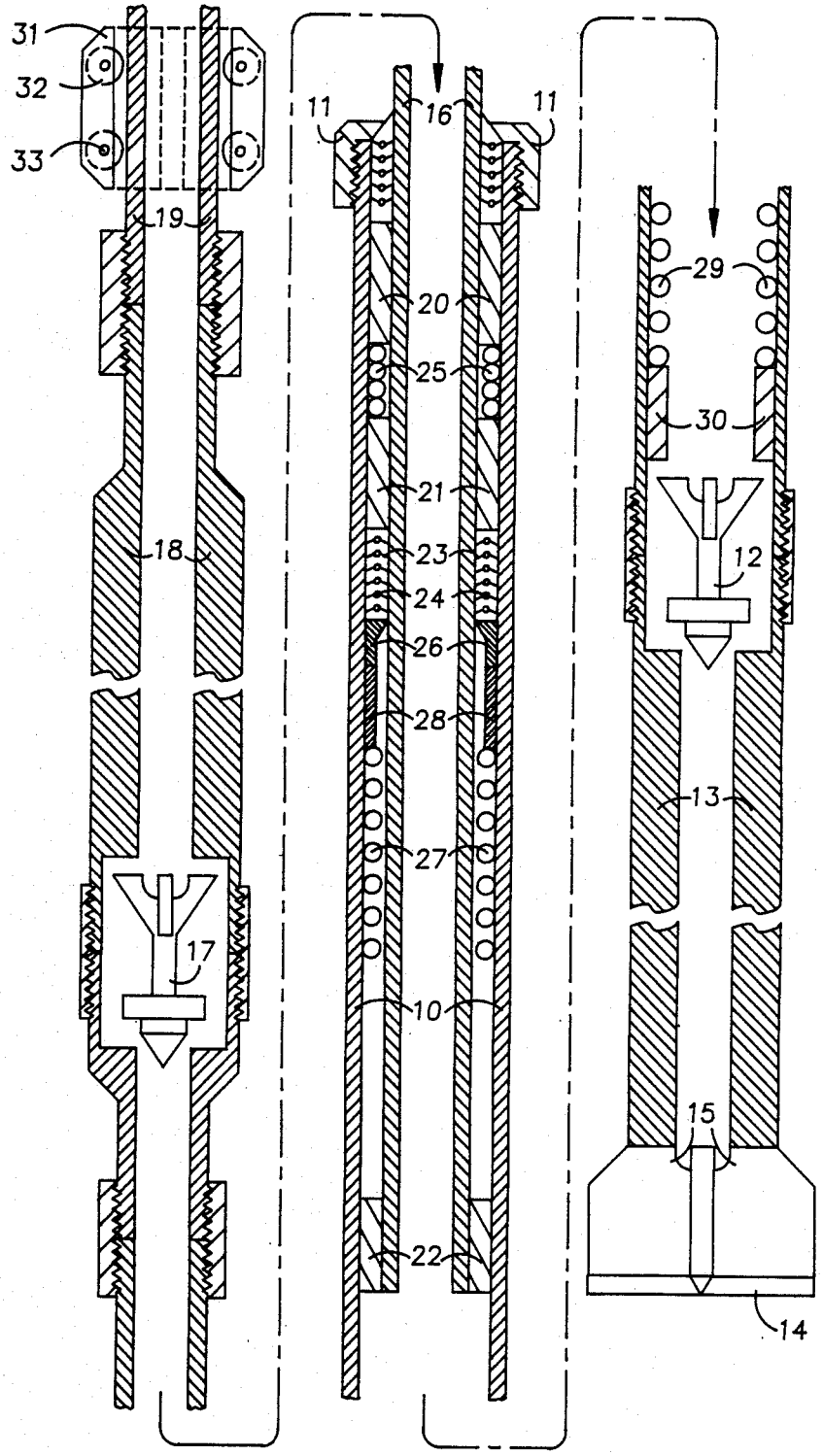

Most oil, gas, geothermal, and water supply wells produce formation solids along with the produced fluids. These formation solids, which are primarily fine sand, sometimes accumulate in the well bottom, often reducing fluid flow from the producing formation, and, often causing down-hole pumps to malfunction. These accumulations of sand must be removed from time to time if production operations are to continue in an economic manner. The general practice is to circulate the sand out of the well by means of a surface pump and the existing string of production tubing, which is progressively lowered as the sand is cleaned out. However, sometimes the sand is bound together by tar, iron oxide, lime, or some other substance, which makes it impossible to circulate the sand out of the well. In other situations the producing zone may be so depleted that it is impossible to circulate the sand out of the bottom of the well because of the low formation pressure in the producing zone which prevents the circulating fluid from returning to the surface.

When it is not possible to circulate the sand out of the well the general practice is to employ a wire-line bailer, or a wire-line sand pump to impact the sand and remove the loosened sand from the bottom of the well. However, this procedure requires a multidude of wire-line round trips to and from the bottom of the well, which is very time consuming. Therefore, if a down-hole sand pump were constructed that could impact the consolidated sand at the bottom of the well, and continuously pump the loosened sand, along with the cirulating fluid, to the surface, such a sand pump system would take considerably less time than the wire-line methods currently in use. If such a down-hole sand pump system were to force the circulating fluid and the sand up through a string of tubing, then there would be no pump pressure applied directly to the producing zone, and, therefore, such a pump system could perform its work regardless of the formation pressure.

A down-hole sand pump that is required to force sand-laden fluid to the surface, sometimes against a considerable pressure head, must be designed and constructed in such a manner so as to prevent the abrasive fluid from eroding components of the pump that are vulnerable to such abrasive fluid. Therefore, such a down-hole sand pump must be equipped with an adequate seal and wiper system so as to prevent fine sand from entering such a vulnerable component system, and such a down-hole sand pump must be equipped with a means to automatically adjust the seal and wiper system to compensate for wear of this component system.

Whereas the inside of the lightweight composite pipe would be protected from the abrasive sand-laden fluid by the Magnus effect created by the turbulently-flowing fluid which creates a two-phase transport core centered within the composite pipe, the outside of the composite pipe must be protected against abrasion from the steel casing or the formation wall, particularly, in high-angle directionally-drilled wells. Therefore, the outside of the lightweight composite pipe must be prevented from coming in contact with any surface that might damage the wall of the composite pipe, yet such a pipe-protector system must be designed and constructed in such a manner so that the pipe-protector system itself does not wear or otherwise damage the wall of the composite pipe.

SUMMARY OF INVENTION

It is among the objects of the invention to provide a new and improved reciprocating down-hole sand pump that is able to impact indurated sand that occupies the bottom of oil, gas, geothermal, and water-supply wells, and disaggregate such sand accumulations so that the sand may be continuously pumped through lightweight composite pipe to the surface along with the circulating fluid, regardless of the formation pressure of the producing zone.

Another object of the invention is to provide a new and improved reciprocating down-hole sand pump that is equipped with an extrusion-resistant self-lubricating pressure-actuated, spring-loaded self-actuated, and self-adjusting seal and wiper system so as to provide positive sealing action and sufficient wiping action to exclude fine sand from the seal and wiper system.

Still another object of the invention is to provide a new and improved reciprocating down-hole sand pump that features low-friction pipe guides or pipe protectors, which guide the lightweight composite pipe by means of small wheels, and prevent the pipe from coming in contact with the well casing or formation wall which otherwise might damage the composite pipe.

With these and other objects in view, the invention consists in the arrangement and combination of the various components whereby the objects contemplated are attained, as hereinafter set forth, in the appended claims and accompanying drawing.

In the drawing:

FIG. 1 is a schematic sectional view of the reciprocating down-hole sand pump.

Drawing on a typical condition as an example in describing components of the invention, it can be assumed that the pump barrel is fabricated from ordinary carbon steel, measuring four inches in inside diameter, and its inside surface is honed to close tolerences, coated with a hard chrome plating, and honed again to the same finish as that of oil-field mud-pump liners. Below the pump barrel is a check valve, or foot valve, also fabricated from carbon steel, but hardfaced with tungsten carbide on those surfaces that face into the abrasive sand-laden fluid passing through the valve. Below the foot valve is a heavy steel cylinder, or weight drop, that terminates in a bladed percussion bit, which is also hardfaced with tungsten carbide, and fitted with suction ports between the blades that lead into the inside of the heavy cylindrical weight drop.

The pumping action is achieved by means of a smaller-diameter plunger pipe which strokes back and forth inside the pump barrel, and is topped by a second check valve, or travelling valve. The plunger pipe, which is also fabricated from ordinary carbon steel, is precision ground and hardfaced with the same nickel-chromium-boron-silicon material that is used in oil-well polished rods, and the surface is polished to the same specifications as those required for polished rods. Above the top check valve, or travelling valve, is the steel cylindrical weighted momentum unit, which axially oscillates the polished plunger pipe, and is itself oscillated axially by the composite pipe above it, which, in turn, is axially oscillated from the surface.

The space between the polished plunger pipe and the pump barrel is occupied by the sealing and wiping system, which consists of spring-energized and self-lubricating V-rings arranged in two V-ring stacks that face in opposite directions, and are separated by a coil spring and two graphited bronze bushings which centralize the polished plunger pipe within the pump barrel as the former is stroked back and forth within the latter. The top V-ring stack is prevented from upward displacement by means of a collar cap threaded onto the top of the pump barrel which also functions as a fish neck, whereas the lower V-ring stack is prevented from downward displacement by means of a bronze retainer positioned just below the lower V-ring stack.

During the up-stroke of the polished plunger pipe the travelling valve closes and the foot valve opens, and the sand-laden fluid is drawn through the suction ports, through the cylindrical weight drop, through the opened foot valve, and through the inside of the pump barrel. During the down-stroke of the polished plunger pipe, the foot valve closes and the travelling valve opens and the sand-laden fluid is forced up through the inside of the polished plunger pipe, through the open travelling valve, through the inside of the cylindrical weighted momentum unit, and through the inside of the composite pipe to the surface.

A fluted pick-up collar affixed to the lower end of the polished plunger pipe provides the means to pick up the lower pump assembly, from the pump barrel down to the bladed terminus, which makes it possible to simultaneously stroke the pump and impact the bottom of the well with the bladed bit, or alternately stroke the pump and impact the bottom of the well with the bladed bit. When impacting the bottom of the well the lower pump assembly is picked up and dropped by means of the pick-up collar, which is fluted to facilitate fluid bypass and prevent fluid compression above the pick-up collar. On the pick-up the pick-up collar impinges upon a coil-spring shock absorber, which is positioned below an internal shoulder affixed to the pump barrel just below the bronze V-stack retainer. A similar coil spring is positioned in a similar manner at the bottom of the pump barrel so as to provide shock absorption against the pick-up collar should the polished plunger pipe ever bottom out at the bottom of the pump barrel. The pick-up collar also assists the bushings in centralizing the polished plunger pipe within the pump barrel.

On the down-stroke of the polished plunger pipe the V-rings in the bottom V-ring stack pressure actuate whereas on the up-stroke of the polished plunger pipe the V-rings in the top V-ring stack pressure actuate. But since each V-ring is self actuated or internally energized by its own little coil spring, the V-rings also self-actuate on the suction strokes, and therefore wipe fine sand off the sliding or dynamic surface of the polished plunger pipe and exclude fine sand from the static sealing surface inside the pump barrel. Therefore, on the down-stroke of the polished plunger pipe the lower V-ring stack pressure-actuates and seals while the top V-ring stack self-actuates so as to wipe and exclude sand, whereas on the up-stroke of the polished plunger pipe the top V-ring stack pressure-actuates and seals while the bottom V-ring stack self-actuates so as to wipe and exclude sand.

As the graphite-filled self-lubricating self-actuated fluorocarbon V-ring lips gradually wear back at their sealing surfaces, both V-ring stacks are continuously subjected to a longitudinal compressional stress from the stored energy within the large fully-compressed coil spring between the two centralizing and graphited bronze bushings. This stored energy is transmitted from the large coil spring through each floating bushing to the V-rings stacks that butt against the distal ends of both bushings, which transversly compresses the small self-energizing coil springs within the fluorocarbon V-rings. Consequently, this longitudinal compressional stress within the two V-ring stacks is translated, via the small self-energizing coil springs within each V-ring, into radial stresses which force the V-ring lips against any sealing surfaces that might be wearing back and at the same time the longitudinal compressional stress shortens the V-ring stacks so as to automatically and progressively compensate for lip wear as the lip wear progresses. This same mechanism also assists the V-ring lips in performing their self-actuated wiping and exclusion tasks during suction strokes.

Since the self-lubricating V-rings stack together in a congruent manner and since the V-ring stacks are straight-sided at their sealing surfaces there are no voids into which the V-rings may extrude if subjected to a high-temperature and high-pressure environment, consequently, this sealing and wiping system should provide satisfactory service in deep oil, gas, and geothermal wells.

For vertical wells, or nearly vertical wells, hardfacing of the couplings that join the composite pipe together would adequately protect the composite pipe from abrasion against the well casing or the formation wall. For high-angle directionally-drilled wells wheeled pipe guides would be necessary to prevent the composite pipe from scraping against the casing or the formation wall. Such wheeled pipe guides, which resemble wheeled sucker-rod guides, would be fabricated from fiberglass or some other suitable material, and would provide a low-friction means to support and guide the composite pipe within the well in such a manner that the composite pipe would not be damaged by either the well casing, formation wall, or the pipe guide itself. Since the wheels would rotate on self-lubricating fluorocarbon axles and bushings, and would contact only the composite pipe and not the casing or the formation wall, the wheel guide system should provide long service.

FIG. 1 illustrates a typical embodiment of the invention and depicts the pump barrel 10, which is topped by the threaded collar cap and fish neck, 11, and is connected to the foot-valve assembly enclosing the check valve, 12, which in turn is connected to the heavy cylindrical weight drop, 13, which connects to the bladed bit, 14, fitted with suction ports, two of which are depicted by 15. The polished plunger pipe, 16, which strokes back and forth within the pump barrel, 10, is connected to the travelling valve assembly enclosing the check valve, 17, which in turn is connected to the weighted momentum unit, 18, which connects to the composite pipe, 19.

The polished plunger pipe, 16, is centralized inside the pump barrel, 10, by two bushings, 20, and 21, and by the pick-up collar, 22, while the two opposing V-ring stacks constitute the sealing and wiping system between the polished plunger pipe, 16, and the pump barrel, 10. The V-ring stacks are composed of a plurality of V-rings, one of which is designated, 23, and each of which are energized by small coil springs, one of which is designated, 24, and by a large fully-compressed coil spring, 25, which also automatically compresses the V-ring stacks to compensate for V-ring wear. Upward displacement of the top V-ring stack is prevented by the collar cap and fish neck, 11, while downward displacement of the bottom V-ring stack is prevented by the retainer, 26.

The lower part of the pump assembly is picked up and dropped by means of the pick-up collar, 22, which impinges upon a shock absorber coil spring, 27, which in turn impinges upon an internal shoulder, 28, affixed to the pump barrel, 10. The pick-up collar, 22, when it impinges upon a lower shock-absorber coil spring, 29, which butts against a lower internal shoulder, 30, also provides shock absorption should the polished plunger pipe, 16, ever bottom-out against the bottom of the pump barrel, 10.

For high-angle directional wells the composite pipe, 19, is protected from scraping the well casing or formation wall by the wheeled pipe guide, 31, which supports and guides the composite pipe by means of small wheels, one of which is designated, 32, and which rotates upon an axle and bushing system, one of which is designated, 33.

A graphite-filled fluorocarbon such as tetrafluorethylene, otherwise known as TFE, or Tephlon, reinforced with fiberglass would generally be used for the V-ring material and the axle and bushing system for the guide wheels, whereas certain other additives may be required such as carbon and molybdinum disulfide, so as to increase the wear resistance of the fluorocarbon components. Corrosion-resistant steel would be used for both the large coil spring and the small V-ring springs.

The wheel-guide assemblies, as well as the wheels themselves, would be fabricated from pultruded fiberglass or some other suitable lightweight material.

Having described examples of employing the present invention, I claim:

1. The invention of a continuously-operated reciprocating down-hole sand pump comprising:

a steel polished plunger pipe that strokes back and forth within a steel honed pump barrel, and is equipped with a self-lubricating fluorocarbon V-ring system that is pressure-actuated during compression strokes, the self-lubricating fluorocarbon V-ring system also is self-actuated by means of coil springs to provide wiping action to the polished plunger pipe during suction strokes, the self-lubricating fluorocarbons V-ring system also self-adjusts by means of coil springs located adjacent the fluorocarbon V-ring so as to automatically compensate for V-ring wear, the self-lubricating fluorocarbon V-ring system also is designed in such a manner so as to eliminate voids and discourage the extrusion of V-rings in high temperature and high-pressure applications.

a foot valve in the pump barrel and a travelling valve in the polished plunger pipe which are actuated by presure-gradient reversals created during the cyclic stroke reversals of the reciprocating down-hole sand pump, a steel cylindrical weight drop, attached bit, and suction ports, which provide the means to loosen consolidated sand at the bottom of oil, gas, geothermal, and water-supply wells, a steel cylindrical weighted momentum unit which axially oscillates the polished plunger pipe, or strokes the reciprocating down-hole pump, and oscillates the heavy cylindrical weight drop and bit.

a string of lightweight composite pipe which axially oscillates the weighted momentum unit, a means at the surface to axially oscillate the lightweight composite pipe string, a low-friction pipe guide system that supports and guides by means of small wheels the axially oscillating composite pipe within high-angle directionally-drilled wells so as to prevent the composite pipe from contacting the well casing or formation wall.

* * * * *